US007048049B2

(12) United States Patent
Zupanick

(10) Patent No.: US 7,048,049 B2
(45) Date of Patent: May 23, 2006

(54) SLANT ENTRY WELL SYSTEM AND METHOD

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 0 days.

(21) Appl. No.: 10/004,316

(22) Filed: Oct. 30, 2001

(65) Prior Publication Data

US 2005/0161216 A1 Jul. 28, 2005

(51) Int. Cl.
*E21B 43/30* (2006.01)

(52) U.S. Cl. ..... 166/245; 175/62

(58) Field of Classification Search ..... 166/313, 166/117.6, 242.1, 245, 263, 50; 175/61, 62
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |
| 1,488,106 | A | 3/1924 | Fitzpatrick |
| 1,520,737 | A | 12/1924 | Wright |

(Continued)

FOREIGN PATENT DOCUMENTS

| | | | |
|---|---|---|---|
| CA | 2210866 | | 1/1998 |
| CA | 2278735 | | 1/1998 |
| CH | 653741 | A5 | 1/1986 |
| DE | 197 25 996 | A1 | 1/1998 |
| EP | 0 819 834 | A1 | 1/1998 |
| EP | 0 875 661 | A | 11/1998 |
| EP | 0 950 300 | A1 | 10/1999 |
| EP | 1 316 673 | A2 | 6/2003 |
| FR | 964503 | | 4/1944 |
| GB | 444484 | | 3/1936 |

(Continued)

OTHER PUBLICATIONS

Langley, Diane, "Potential Impact of Microholes Is Far From Diminutive," JPT Online, http://www.spe.org/spe/jpt/jps, Nov. 2004 (5 pages).

Consol Energy Slides, "Generating Solutions, Fueling Change," Presented at Appalachian E&P Forum, Harris Nesbitt Corp., Boston, Oct. 14, 2004 (29 pages).

Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.

Schenk, Christopher J., "Geologic Definition and Resource Assessment of Continuous (Unconventional) Gas Accumulations—the U.S. Experience," Website, http://aapg.confex.com/ . . . //, printed Nov. 16, 2004 (1 page).

(Continued)

*Primary Examiner*—David Bagnell
*Assistant Examiner*—Daniel P Stephenson
(74) *Attorney, Agent, or Firm*—Fish & Richardson P.C.

(57) ABSTRACT

A system for accessing a subterranean zone from the surface includes an entry well bore extending down from the surface. A plurality of slanted well bores extend from the entry well bore to the subterranean zone. Drainage patterns extend from the slanted well bores into the subterranean zone.

21 Claims, 7 Drawing Sheets

U.S. PATENT DOCUMENTS

| | | | | |
|---|---|---|---|---|
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,797,893 | A | 7/1957 | McCune et al. | |
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,208,537 | A | 9/1965 | Scarborough | |
| 3,347,595 | A | 10/1967 | Dahms et al. | 299/4 |
| 3,385,382 | A | 5/1968 | Canalizo et al. | |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,582,138 | A | 6/1971 | Loofbourow et al. | |
| 3,587,743 | A | 6/1971 | Howard | |
| 3,684,041 | A | 8/1972 | Kammerer, Jr. et al. | 175/267 |
| 3,692,041 | A | 9/1972 | Bondi | 137/238 |
| 3,744,565 | A | 7/1973 | Brown | |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Anderrson | 137/625.4 |
| 4,020,901 | A | 5/1977 | Pisio et al. | |
| 4,022,279 | A | 5/1977 | Driver | 166/271 |
| 4,030,310 | A | 6/1977 | Schirtzinger | 61/86 |
| 4,037,658 | A | 7/1977 | Anderson | 166/272 |
| 4,060,130 | A | 11/1977 | Hart | |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | |
| 4,136,996 | A | 1/1979 | Burns | 405/195 |
| 4,151,880 | A | 5/1979 | Vann | |
| 4,156,437 | A | 5/1979 | Chivens et al. | 137/554 |
| 4,169,510 | A | 10/1979 | Meigs | 175/65 |
| 4,182,423 | A | 1/1980 | Ziebarth et al. | |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,222,611 | A | 9/1980 | Larson et al. | |
| 4,224,989 | A | 9/1980 | Blount | |
| 4,226,475 | A | 10/1980 | Frosch et al. | |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | 166/266 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,415,205 | A | 11/1983 | Rehm et al. | |
| 4,417,829 | A | 11/1983 | Berezoutzky | |
| 4,422,505 | A | 12/1983 | Collins | |
| 4,437,706 | A | 3/1984 | Johnson | 299/7 |
| 4,442,896 | A | 4/1984 | Reale et al. | 166/278 |
| 4,463,988 | A | 8/1984 | Bouck et al. | |
| 4,494,616 | A | 1/1985 | McKee | 175/67 |
| 4,502,733 | A | 3/1985 | Grubb | |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,533,182 | A | 8/1985 | Richards | |
| 4,536,035 | A | 8/1985 | Huffman et al. | |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,603,592 | A | 8/1986 | Siebold et al. | |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,651,836 | A | 3/1987 | Richards | |
| 4,674,579 | A | 6/1987 | Geller et al. | 175/45 |
| 4,702,314 | A | 10/1987 | Huang et al. | 166/245 |
| 4,705,431 | A | 11/1987 | Gadelle et al. | 405/267 |
| 4,715,440 | A | 12/1987 | Boxell et al. | 166/100 |
| 4,753,485 | A | 6/1988 | Goodhart | |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,776,638 | A | 10/1988 | Hahn | |
| 4,830,105 | A | 5/1989 | Petermann | 166/241 |
| 4,832,122 | A | 5/1989 | Corey et al. | |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/263 |
| 4,889,186 | A | 12/1989 | Hanson et al. | |
| 4,978,172 | A | 12/1990 | Schwoebel et al. | 299/12 |
| 5,016,710 | A | 5/1991 | Renard et al. | 166/245 |
| 5,035,605 | A | 7/1991 | Dinerman et al. | 481/18 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,111,893 | A | 5/1992 | Kvello-Aune | 175/258 |
| 5,121,244 | A | 6/1992 | Takasaki | 359/161 |
| 5,127,457 | A | 7/1992 | Stewart et al. | |
| 5,135,058 | A | 8/1992 | Millgard et al. | 175/71 |
| 5,148,875 | A | 9/1992 | Karlsson et al. | 175/62 |

5,148,877 A 9/1992 MacGregor
5,165,491 A 11/1992 Wilson ..... 175/62
5,168,942 A 12/1992 Wydrinski ..... 175/50
5,174,374 A 12/1992 Hailey ..... 166/55.8
5,193,620 A 3/1993 Braddick ..... 166/382
5,194,859 A 3/1993 Warren ..... 340/853.4
5,194,977 A 3/1993 Nishio ..... 359/128
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,226,495 A 7/1993 Jennings, Jr. ..... 166/278
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,301,760 A 4/1994 Graham ..... 175/61
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al.
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,584,605 A 12/1996 Beard et al. ..... 405/128
5,613,242 A 3/1997 Oddo ..... 588/17
5,615,739 A 4/1997 Dallas ..... 166/306
5,653,286 A 8/1997 McCoy et al.
5,659,347 A 8/1997 Taylor ..... 347/85
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4
5,697,445 A 12/1997 Graham
5,706,442 A 1/1998 Anderson et al. ..... 141/59
5,720,356 A 2/1998 Gardes ..... 175/62
5,727,629 A 3/1998 Blizzard, Jr. et al. ..... 166/298
5,735,350 A 4/1998 Longbottom et al. ..... 166/313
5,771,976 A 6/1998 Talley ..... 166/370
5,775,433 A 7/1998 Hammett et al.
5,775,443 A 7/1998 Lott
5,785,133 A 7/1998 Murray et al. ..... 175/61
5,832,958 A 11/1998 Cheng ..... 137/625.41
5,852,505 A 12/1998 Li ..... 359/118
5,853,054 A 12/1998 McGarian et al. ..... 175/267
5,853,056 A 12/1998 Landers ..... 175/424
5,853,224 A 12/1998 Riese
5,863,283 A 1/1999 Gardes ..... 588/250
5,867,289 A 2/1999 Gerstel et al. ..... 359/110
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,912,754 A 6/1999 Koga et al. ..... 359/179
5,914,798 A 6/1999 Liu ..... 359/161
5,917,325 A 6/1999 Smith ..... 324/326
5,934,390 A 8/1999 Uthe ..... 175/67
5,938,004 A 8/1999 Roberts et al. ..... 198/812
5,941,308 A 8/1999 Malone et al.
5,957,539 A 9/1999 Durup et al. ..... 299/4
5,971,074 A 10/1999 Longbottom et al. ..... 166/313
6,012,520 A 1/2000 Yu et al. ..... 166/245
6,015,012 A 1/2000 Reddick ..... 166/313
6,019,173 A 2/2000 Saurer et al.
6,024,171 A 2/2000 Montgomery et al. ..... 166/308
6,030,048 A 2/2000 Hsu
6,050,335 A 4/2000 Parsons ..... 166/272.3
6,056,059 A * 5/2000 Ohmer ..... 166/313
6,062,306 A 5/2000 Gano et al.
6,065,550 A 5/2000 Gardes ..... 175/62
6,065,551 A 5/2000 Gourley et al.
6,119,771 A 9/2000 Gano et al. ..... 166/50
6,119,776 A 9/2000 Graham et al.
6,135,208 A 10/2000 Gano et al. ..... 166/313
6,179,054 B1 1/2001 Stewart
6,189,616 B1 2/2001 Gano et al.
6,209,636 B1 4/2001 Roberts et al. ..... 166/117.6
6,237,284 B1 5/2001 Erickson
6,244,340 B1 6/2001 McGlothen et al.
6,279,658 B1 8/2001 Donovan et al.
6,280,000 B1 8/2001 Zupanick ..... 299/12
6,349,769 B1 2/2002 Ohmer ..... 166/313
6,357,523 B1 3/2002 Zupanick ..... 166/52
6,357,530 B1 3/2002 Kennedy et al.
6,425,448 B1 7/2002 Zupanick et al. ..... 175/61
6,439,320 B1 8/2002 Zupanick ..... 175/161
6,450,256 B1 9/2002 Mones ..... 166/250.01
6,454,000 B1 9/2002 Zupanick
6,457,540 B1 10/2002 Gardes ..... 175/62
6,497,556 B1 12/2002 Zupanick et al.
6,566,649 B1 5/2003 Mickael ..... 250/269.3
6,571,888 B1 6/2003 Comeau et al. ..... 175/61
6,575,235 B1 6/2003 Zupanick et al.
6,575,255 B1 6/2003 Rial et al.
6,577,129 B1 6/2003 Thompson et al. ..... 324/338
6,585,061 B1 7/2003 Radzinski et al. ..... 175/45
6,590,202 B1 7/2003 Mickael ..... 250/269.2
6,591,903 B1 7/2003 Ingle et al. ..... 166/50
6,591,922 B1 7/2003 Rial et al.
6,595,301 B1 7/2003 Diamond et al.
6,595,302 B1 7/2003 Diamond et al.
6,604,580 B1 8/2003 Zupanick et al.
6,604,910 B1 8/2003 Zupanick
6,607,042 B1 8/2003 Hoyer et al. ..... 175/38
6,636,159 B1 10/2003 Winnacker ..... 340/854.3
6,639,210 B1 10/2003 Odom et al. ..... 250/269.6
6,644,422 B1 11/2003 Rial et al.
6,646,441 B1 11/2003 Thompson et al.
6,653,839 B1 11/2003 Yuratich et al. ..... 324/355
6,668,918 B1 12/2003 Zupanick
6,679,322 B1 1/2004 Zupanick
6,688,388 B1 2/2004 Zupanick
6,708,764 B1 3/2004 Zupanick
6,722,452 B1 4/2004 Rial et al.
6,725,922 B1 4/2004 Zupanick
2002/0007968 A1 1/2002 Gardes
2002/0043404 A1 4/2002 Trueman et al.
2002/0050358 A1 5/2002 Algeroy et al. ..... 166/313
2002/0074120 A1 6/2002 Scott ..... 166/313

| | | | | |
|---|---|---|---|---|
| 2002/0096336 | A1 | 7/2002 | Zupanick et al. | |
| 2002/0189801 | A1 | 12/2002 | Zupanick et al. | |
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0164253 | A1 | 9/2003 | Trueman et al. | |
| 2003/0217842 | A1 | 11/2003 | Zupanick et al. | |
| 2003/0221836 | A1 | 12/2003 | Gardes | |
| 2004/0007389 | A1 | 1/2004 | Zupanick et al. | |
| 2004/0007390 | A1 | 1/2004 | Zupanick | |
| 2004/0011560 | A1 | 1/2004 | Rial et al. | |
| 2004/0031609 | A1 | 2/2004 | Zupanick | |
| 2004/0033557 | A1 | 2/2004 | Scott et al. | |
| 2004/0035582 | A1 | 2/2004 | Zupanick | |
| 2004/0045719 | A1 | 3/2004 | Moore et al. | |
| 2004/0050552 | A1 | 3/2004 | Zupanick | |
| 2004/0050554 | A1 | 3/2004 | Zupanick et al. | |
| 2004/0055787 | A1 | 3/2004 | Zupanick | |
| 2004/0060351 | A1 | 4/2004 | Gunter et al. | |
| 2004/0140129 | A1 | 7/2004 | Gardes | |
| 2004/0226719 | A1 | 11/2004 | Morgan et al. | |

FOREIGN PATENT DOCUMENTS

| | | | |
|---|---|---|---|
| GB | 651468 | | 4/1951 |
| GB | 893869 | | 4/1962 |
| GB | SU-750108 | | 6/1975 |
| GB | SU-1448078 | A1 | 3/1987 |
| GB | SU-1770570 | A1 | 3/1990 |
| GB | 2 255 033 | A | 10/1992 |
| GB | 442008 | | 1/1996 |
| GB | 2 297 988 | | 8/1996 |
| GB | 2 297 988 | A | 8/1996 |
| GB | 2 347 157 | A | 8/2000 |
| SU | 750108 | | 6/1975 |
| SU | 876968 | | 10/1981 |
| SU | 1448078 | A1 | 3/1987 |
| SU | 1770570 | A1 | 3/1990 |
| WO | 94/21889 | | 9/1994 |
| WO | WO 94/28280 | | 12/1994 |
| WO | WO 97/21900 | | 6/1997 |
| WO | WO 98/35133 | | 8/1998 |
| WO | WO 99/60248 | | 11/1999 |
| WO | WO 00/31376 | | 6/2000 |
| WO | 00/79099 | | 12/2000 |
| WO | WO 01/44620 | | 6/2001 |
| WO | WO 02/18738 | A1 | 3/2002 |
| WO | WO 02/18738 | | 3/2002 |
| WO | WO 02/059455 | A1 | 8/2002 |
| WO | WO 02/061238 | A1 | 8/2002 |
| WO | 02/0859455 | | 8/2002 |
| WO | WO 03/102348 | A2 | 12/2003 |
| WO | WO 2004/035984 | A1 | 4/2004 |

OTHER PUBLICATIONS

U.S. Department of Interior, U.S. Geological Survey, "Characteristics of Discrete and Basin–Centered Parts of the Lower Silurian Regional Oil and Gas Accumulation, Appalachian Basin: Preliminary Results From a Data Set of 25 oil and Gas Fields," U.S. Geological Survey Open–File Report 98–216, Website, http://pubs.usgs.gov/of/1998/of98–216/introl.htm, printed Nov. 16, 2004 (2 pages).

Zupanick, J., "Coalbed Methane Extraction," 28$^{th}$ Mineral Law Conference, Lexington, Kentucky, Oct. 16–17, 2003 (48 pages).

Zupanick, J., "CDX Gas—Pinnacle Project," Presentation at the 2002 Fall Meeting of North American Coal Bed Methane Forum, Morgantown, West Virginia, Oct. 30, 2002 (23 pages).

Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22–23, 2004 (51 pages).

Field, Tony, Mitchell Drilling, "Let's Get Technical—Drilling Breakthroughs in Surface to In–Seam in Australia," Presentation at Coal Seam Gas & Mine Methane Conference in Brisbane, Nov. 22–23, 2004 (20 pages).

Zupanick, Joseph A, "Coal Mine Methane Drainage Utilizing Multilateral Horizontal Wells," 2005 SME Annual Meeting & Exhibit, Feb. 28—Mar. 2, 2005, Salt Lake City, Utah (6 pages).

The Official Newsletter of the Cooperative Research Centre for Mining Technology and Equipment, CMTE News 7, "Tight–Radius Drilling Clinches Award," Jun. 2001, 1 page.

Denney, Dennis, "*Drilling Maximum–Reservoir–Contact Wells in the Shaybah Field*," SPE 85307, pp. 60, 62–63, Oct. 20, 2003.

Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.

Brunner, D.J. and Schwoebel, J.J., "Directional Drilling for Methane Drainage and Exploration in Advance of Mining," REI Drilling Directional Underground, World Coal, 1999, 10 pages.

Thakur, P.C., "A History of Coalbed Methane Drainage From United States Coal Mines," 2003 SME Annual Meeting, Feb. 24–26, Cincinnati, Ohio, 4 pages.

U.S. Climate Change Technology Program, "Technology Options for the Near and Long Term," 4.1.5 Advances in Coal Mine Methane Recovery Systems, pp. 162–164.

Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.

Gardes, Robert, "Multi–Seam Completion Technology," Natural Gas Quarterly, E&P, Jun. 2004, pp. 78–81.

Baiton, Nicholas, "Maximize Oil Production and Recovery," Vertizontal Brochure, received Oct. 2, 2002, 4 pages.

Dreiling, Tim, McClelland, M.L. and Bilyeu, Brad, "Horizontal & High Angle Air Drilling in the San Juan Basin, New Mexico," Dated on or about Mar. 6, 2003, pp. 1–11.

Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94–09, paper to be presented Mar. 20–23, 1994, Calgary, Canada, 10 pages.

Fischer, Perry A., "What's Happening in Production," World Oil, Jun. 2001, p. 27.

Website of PTTC Network News vol. 7, 1$^{st}$ Quarter 2001, Table of Contents, http://www.pttc.org/../news/v7n1nn4.htm printed Apr. 25, 2003, 3 pages.

Cox, Richard J. W., "Testing Horizontal Wells While Drilling Underbalanced," Delft University of Technology, Aug. 1998, 68 pages.

McLennan, John, et al., "Underbalanced Drilling Manual," Gas Research Institute, Chicago, Illinois, GRI Reference No. GRI–97/0236, copyright 1997, 502 pages.
The Need for a Viable Multi–Seam Completion Technology for the Powder River Basin, Current Practice and Limitations, Gardes Energy Services, Inc., Believed to be 2003 (8 pages).
Notification of Transmittal of the International Search Report or the Declaration (PCT Rule 44.1) (3 pages) and International Search Report (7 pages) re International Application No. PCT/US 03/04771 mailed Jul. 4, 2003.
Notification of Transmittal of the International Search Report or the Declaration (PCT Rule 44.1) (3 pages) and International Search Report (5 pages) re International Application No. PCT/US 03/21891 mailed Nov. 13, 2003.
Desai, Praful, et al., "*Innovative Design Allows Construction of Level 3 or Level 4 Junction Using the Same Platform*," SPE/Petroleum Society of CIM/CHOA 78965, Canadian Heavy Oil Association, 2002, pp. 1–11.
Bybee, Karen, "*Advanced Openhole Multilaterals*," Horizontal Wells, Nov. 2002, pp. 41–42.
Bybee, Karen, "*A New Generation Multilateral System for the Troll Olje Field*," Multilateral/Extended Reach, Jul. 2002, 2 pages.
Emerson,, A.B., et al., "*Moving Toward Simpler, Highly Functional Multilateral Completions*," Technical Note, Journal of Canadian Petroleum Technology, May 2002, vol. 41, No. 5, pp. 9–12.
Moritis, Guntis, "*Complex Well Geometries Boost Orinoco Heavy Oil Producing Rates*," XP–000969491, Oil & Gas Journal, Feb. 28, 2000, pp. 42–46.
Themig, Dan, "*Multilateral Thinking*," New Technology Magazine, Dec. 1999, pp. 24–25.
Smith, R.C., et al., "*The Lateral Tie–Back System: The Ability to Drill and Case Multiple Laterals*," IADC/SPE 27436, Society of Petroleum Engineers, 1994, pp. 55–64, plus Multilateral Services Profile (1 page) and Multilateral Services Specifications (1 page).
Notification of Transmittal of the International Search Report or the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane*," Hydrocarbons From Coal, Chapter 12, Copyright 1993, Title Page, Copyright Page, pp. 269–285.
Hanes, John, "*Outbursts in Leichhardt Colliery: Lessons Learned*," International Symposium–Cum–Workshop on Management and Control of High Gas Emissions and Outbursts in Underground Coal Mines, Wollongong, NSW, Australia, Mar. 20–24, 1995, Title page, pp. 445–449.
Williams, Ray, et al., "*Gas Reservoir Properties for Mine Gas Emission Assessment*," Bowen Basin Symposium 2000, pp. 325–333.
Brown, K., et al., "*New South Wales Coal Seam Methane Potential*," Petroleum Bulletin 2, Department of Mineral Resources, Discovery 2000, Mar. 1996, pp. i–viii, 1–96.
Fipke, S., et al., "*Economical Multilateral Well Technology for Canadian Heavy Oil*," Petroleum Society, Canadian Institute of Mining, Metallurgy & Petroleum, Paper 2002–100, to be presented in Calgary Alberta, Jun. 11–13, 2002, pp. 1–11.
PowerPoint Presentation entitled, "Horizontal Coalbed Methane Wells," by Bob Stayton, Computalog Drilling Services, date is believed to have been in 2002.
Dreiling, Tim, McClelland, M.L. and Bilyeu, Brad, "Horizontal & High Angle Air Drilling in the San Juan Basin, New Mexico," Believed to be dated Apr. 1996, pp. 1–11.
Technology Scene Drilling & Intervention Services, "Weatherford Moves Into Advanced Multilateral Well Completion Technology"and "Productivity Gains and Safety Record Speed Acceptance of UBS," *Reservoir Mechanics*, Weatherford International, Inc., 2000 Annual Report (2 pages).
"A Different Direction for CBM Wells," *W Magazine*, 2004 Third Quarter (5 pages).
Snyder, Robert E., "What's New in Production," *WorldOil Magazine*, Feb. 2005, [printed from the internet on Mar. 7, 2005], http://www.worldoil.com/magazine/MAGAZINE_DETAIL. asp?ART_ID=2507@MONTH_YEAR (3 pages).
Nazzal, Greg, "Moving Multilateral Systems to the Next Level, Strategic Acquisition Expands Weatherford's Capabilities," 2000 (2 pages).
Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).
Molvar, Erik M., "Drilling Smarter: Using Directional Drilling to Reduce Oil and Gas Impacts in the Intermountain West," Prepared by Biodiversity Conservation Alliances, Report issued Feb. 18, 2003, 34 pages.
King, Robert F., "Drilling Sideways—A Review of Horizontal Well Technology and Its Domestic Application," DOE/EIA–TR–0565, U.S. Department of Energy, Apr. 1993, 30 pages.
Santos, Helio, SPE, Impact Engineering Solutions and Jesus Olaya, Ecopetrol/ICP, "*No–Damage Drilling: How to Achieve this Challenging Goal*?," SPE 77189, Copyright 2002, presented at the IADC/SPE Asia Pacific Drilling Technology, Jakarta, Indonesia, Sep. 9–Nov. 2002, 10 pages.
Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20–23, 2002, 7 pages.
Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20–22, 2003, 8 pages.
P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20–22, 2003, 9 pages.
Craig, C. White and Adrian P. Chesters, NAM; Catalin D. Ivan, Sven Maikranz and Rob Nouris, M–I L.L.C., "*Aphron–based drilling fluid: Novel technology for drilling depleted formations*," World Oil, Drilling Report Special Focus, Oct. 2003, 6 pages.
Robert E. Snyder, "*Drilling Advances*," World Oil, Oct. 2003, 1 page.

U.S. Environmental Protection Agency, "Directional Drilling Technology," prepared for the EPA by Advanced Resources International under Contract 68–W–00–094, Coalbed Methane Outreach Program (CMOP), Website: http://search.epa.gov/s97is.vts, printed Mar. 17, 2005, 13 pages.

Listing of 174 References received from Third Party on Feb. 16, 2005 (9 pages).

Gardes Directional Drilling, "Multiple Directional Wells From Single Borehole Developed," Reprinted from Jul. 1989 edition of Offshore, Copyright 1989 by PennWell Publishing Company (4 pages).

"Economic Justification and Modeling of Multilateral Wells," Economic Analysis, Hart's Petroleum Engineer International, 1997 (4 pages).

Mike Chambers, "Multi–Lateral Completions at Mobil Past, Present, and Future," presented at the 1998 Summit on E&P Drilling Technologies, Strategic Research Institute, Aug. 18–19, 1998 in San Antonio, Texas (26 pages).

David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).

P. Corlay, D. Bossie–Codreanu, J.C. Sabathier and E.R. Delamaide, "Improving Reservoir Management With Complex Well Architectures," Field Production & Reservoir Management, World Oil, Jan. 1997 (5 pages).

Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).

Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).

Gamal Ismail, H. El–Khatib—ZADCO, Abu Dhabi, UAE, "Multi–Lateral Horizontal Drilling Problems & Solutions Experienced Offshore Abu Dhabi," SPE 36252, Society of Petroleum Engineers, Oct. 1996 (12 pages).

C.M. Matthews and L.J. Dunn, "Drilling and Production Practices to Mitigate Sucker Rod/Tubing Wear–Related Failures in Directional Wells," SPE 22852, Society of Petroleum Engineers, Oct. 1991 (12 pages).

H.H. Fields, Stephen Krickovic, Albert Sainato, and M.G. Zabetakis, "Degasification of Virgin Pittsburgh Coalbed Through a Large Borhole," RI–7800, Bureau of Mines Report of Investigations/1973, United States Department of the Interior, 1973 (31 pages).

William P. Diamond, "Methane Control for Underground Coal Mines," IC–9395, Bureau of Mines Information Circular, United States Department of the Interior, 1994 (51 pages).

Chi, Weiguo, "*A feasible discussion on exploitation coalbed methane through Horizontal Network Drilling in China*," SPE 64709, Society of Petroleum Engineers (SPE International), Nov. 7, 2000, 4 pages.

Goktas, B., et al., "*Performance of Openhole Completed and Cased Horizontal/Undulating Wells in Thin–Bedded, Tight Sand Gas Reservoirs*," SPE 65619, Society of Petroleum Engineers, Oct. 17–19, 2000 (7 pages).

Sharma, R., et al., "*Modelling of Undulating Wellbore Trajectories*," The Journal of Canadian Petroleum Technology, vol. 34, No. 10, XP–002261908, Oct. 18–20, 1993 pp. 16–24.

Balbinski, E.F., "*Prediction of Offshore Viscous Oil Field Performance*," European Symposium on Improved Oil Recovery, Aug. 18–20, 1999, pp. 1–6, 9 & 10.

Notification of Transmittal of the International Search Report or the Declaration (PCT Rule 44.1) (3 pages) and International Search Report (4 pages) re International Application No. (PCT/US 03/21626 mailed Nov. 6, 2003.

Notification of Transmittal of the International Search Report or the Declaration (PCT Rule 44.1) (3 pages) and International Search Report (4 pages) re International Application No. PCT/US 03/38383 mailed Jun. 2, 2004.

Notification of Transmittal of the International Search Report or the Declaration (PCT Rule 44.1) (3 pages) and International Search Report (5 pages) re International Application No. PCT/US 03/21627 mailed Nov. 5, 2003.

Notification of Transmittal of the International Search Report or the Declaration (PCT Rule 44.1) (3 pages) and International Search Report (4 pages) re International Application No. PCT/US 03/21628 mailed Nov. 4, 2003.

Notification of Transmittal of the International Search Report or the Declaration (PCT Rule 44.1) (3 pages) and International Search Report (5 pages) re International Application No. PCT/US 03/21750 mailed Dec. 5, 2003.

Notification of Transmittal of the International Search Report or the Declaration (PCT Rule 44.1) (3 pages) and International Search Report (3 pages) re International Application No. PCT/US 03/28137 mailed Dec. 19, 2003.

Notification of Transmittal of the International Search Report or the Declaration (PCT Rule 44.1) (3 pages) and International Search Report (5 pages) re International Application No. PCT/US 03/26124 mailed Feb. 4, 2004.

Notification of Transmittal of the International Search Report or the Declaration (PCT rule 44.1) (3 pages) and International Search Report (6 pages) re International Application No. PCT/US 03/28138 mailed Feb. 9, 2004.

Notification of Transmittal of the International Search Report or the Declaration (PCT Rule 44.1) (3 pages) and International Search Report (6 pages) re International Application No. PCT/US–03/30126 mailed Feb. 27, 2004.

Smith, Maurice, "*Chasing Unconventional Gas Unconventionally*," CBM Gas Technology, New Technology Magazine, Oct./Nov. 2003, pp. 1–4.

Gardes, Robert, "A New Direction in Coalbed Methane and Shale Gas Recovery," (to the best of Applicants' recollection, first received at The Canadian Institute Coalbed Methane Symposium conference on Jun. 16 and Jun. 17, 2002), 1 page of conference flyer, 6 pages.

Gardes, Robert, "*Under–Balance Multi–Lateral Drilling for Unconventional Gas–Recovery*," (to the best of Applicants' recollection, first received at The Unconventional Gas Revolution–conference on Dec. 9, 2003, 4 pages of conference flyer, 33 pages.

Boyce, Richard G., "*High Resolution Selsmic Imaging Programs for Coalbed Methane Development*," (to the best of Applicants' recollection, first received at The Unconventional Gas Revolution conference on Dec. 10, 2003), 4 pages of conference flyer, 24 pages.

Mazzella, Mark, et al., "*Well Control Operations on a Multiwell Platform Blowout*," WorldOil.com—Online Magazine Article, vol. 22, Part 1—pp. 1–7, Jan. 2001, and Part II, Feb. 2001, pp. 1–13.

Vector Magnetics, LLC, Case Histor, California, May 1999, "*Successful Kill of a Surface Blowout*," 1999, pp. 1–12.

Cudd Pressure Control, Inc, "*Successful Well Control Operations—A Case Study: Surface and Subsurface Well Intervention on a Multi–Well Offshore Platform Blowout and Fire*," 2000, pp. 1–17, http://www.cuddwellcontrol.com/literature/successful/successful_well.htm.

Purl, R., et al., "*Damage to Coal Permeability During Hydraulic Fracturing*," SPE 21813, 1991, pp. 109–115.

U.S. Dept. of Energy—Office of Fossil Energy, "*Multi–Seam Well Completion Technology: Implications for Powder River Basin Coalbed Methane Production*," pp. 1–100, A–1 through A–10, Sep. 2003.

U.S. Dept. of Energy—Office of Fossil Energy, "*Powder River Basin Coalbed Methane Development and Produced Water Management Study*," pp. 1–111, A–1 through A–14, Nov. 2002.

Fletcher, Sam "*Anadarko Cuts Route Under Canadian River Gorge*," Oil & Gas Journal, pp. 28–30, Jan. 5, 2004.

Kalinin, et al., Translation of Selected Pages from Ch. 4, Sections 4.1, 4.4, 4.4.1, 4.4.3, 11.2.2, 11.2.4 and 11.4, "*Drilling Inclined and Horizontal Well Bores*," Moscow, Nedra Publishers, 15 pages, 1997.

Kalinin, et al., Translocation of Selected Pages from Ch. 4, Sections 4.2 (p. 135), 10.1 (p. 402), 10.4 (pp. 418–419), "*Drilling Inclined and Horizontal Well Bores*," Moscow, Nedra Publishers, 4 pages, 1997.

Arens, V. Zh., Translocation of Selected Pages, "*Well–Drilling Recovery of Minerals*," Moscow, Nedra Publishers, 7 pages, 1986.

Jet Lavanway Exploration, "*Well Survey*," Key Energy Surveys, 3 pages, Nov. 2, 1997.

Precision Drilling, "*We Have Roots in Coal Bed Methane Drilling*," Technology Services Group, 1 page, Published on or before Aug. 5, 2002.

U.S. Dept. of Energy, "*New Breed of CBM/CMM Recovery Technology*", 1 page, Jul. 2003.

Ghiselin, Dick, "*Unconventional Vision Frees Gas Reserves*," Natural Gas Quarterly, 2 pages, Sep. 2003.

CBM Review, World Coal, "*US Drilling into Asia*," 4 pages, Jun. 2003.

Skrebowski, Chris, "*US Interest in North Korean Reserves*," Petroleum, Energy Institute, 4 pages, Jul. 2003.

Zupanick, et al., U.S. Patent Application entitled "Method and System for Underground Treatment of Materials," U.S. Appl. No. 10/142,817, filed May 8, 2002.

Zupanick, et al, U.S. Patent Application entitled "Method and System for Controlling Pressure in a Dual Well System," U.S. Appl. No. 10/244,082, filed Sep. 12, 2002.

Diamond et al., U.S. Patent Application entitled "Method and System for Removing Fluid From a Subterranean Zone Using an Enlarged Cavity," U.S. Appl. No. 10/264,535, filed Oct. 3, 2002.

Zupanick, U.S. Patent Application entitled "Method of Drilling Lateral Wellbores From a Slant Well Without Utilizing a Whipstock," U.S. Appl. No. 10/267,426, filed Oct. 8, 2002.

Rial et al., U.S. Patent Application entitled "Method and System for Controlling the Production Rate Of Fluid From A Subterranean Zone To Maintain Production Bore Stability In The Zone," U.S. Appl. No. 10/328,408, filed Dec. 23, 2002.

Zupanick, et al., U.S. Patent Application entitled "Method and System for Recirculating Fluid in a Well System," U.S. Appl. No. 10/457,103, filed Jun. 5, 2003.

Zupanick, U.S. Patent Application entitled "Method and System for Accessing Subterranean Deposits from the Surface and Tools Therefor," U.S. Appl. No. 10/630,345 filed Jul. 29, 2003.

Pauley, Steven, U.S. Patent Application entitled "Multi–Purpose Well Bores and Method for Accessing a Subterranean Zone From the Surface," U.S. Appl. No. 10/715,300, filed Nov. 17, 2003.

Seams, Douglas, U.S. Patent Application entitled "Method and System for Extraction of Resources from a Subterranean Well Bore," U.S. Appl. No. 10/723,322, filed Nov. 26, 2003.

Zupanic, U.S. Patent Application entitled "Slant Entry Well System and Method," U.S. Appl. No. 10/749,884, filed Dec. 31, 2003.

Zupanic, U.S. Patent Application entitled "Method and System for Accessing Subterranean Deposits from the Surface," U.S. Appl. No. 10/761,629, filed Jan. 20, 2004.

Zupanic, U.S. Patent Application entitled "Method and System for Testing A Partially Formed Hydrocarbon Well for Evaluation and Well Planning Refinement," U.S. Appl. No. 10/769,221, filed Jan. 30, 2004.

Platt, "Method and System for Lining Multilateral Wells," U.S. Appl. No. 10/772,841, filed Feb. 5, 2004.

Zupanick, "Three–Dimentsional Well System For Accessing Subterranean Zones," Feb. 11, 2004, U.S. Appl. No. 10/777,503.

Zupanick, "System And Method For Directional Drilling Utilizing Clutch Assembly," U.S. Appl. No. 10/811,118, filed Mar. 25, 2004.

Zupanick et al., "Slot Cavity," U.S. Appl. No. 10/419,529, Apr. 21, 2003.

Zupanick, "System and Method for Multiple Wells from a Common Surface Location," U.S. Appl. No. 10/788,684, Feb. 27, 2004.

Zupanick, "Method and System for Accessing a Subterranean Zone From Limited Surface Area," U.S. Appl. No. 10/406,037, filed Apr. 2, 2003 (Publication 2003/0217842).

Palmer, Ian D., et al., "*Coalbed Methane Well Completions and Stimulations*", Chapter 14, Hydrocarbons From Coal, American Association of Petroleum Geologists, 1993, pp. 303–339.

Field, T.W., "*Surface to In–seam Drilling—The Australian Experience*," 10 pages, Undated.

Drawings included in CBM well permit issued to CNX stamped Apr. 15, 2004 by the West Virginia Department of Environmental Protection (4 pages).

Website of Mitchell Drilling Contractors, "*Services: Dymaxion—Surface to In–seam*," http://www.mitchell drilling-.com/dymaxion.htm, printed as of Jun. 17, 2004, 4 pages.

Website of CH4, "About Natural Gas—Technology," http://www.ch4.com.au/ng_technology.html, copyright 2003, printed as of Jun. 17, 2004, 4 pages.

Thomson, et al., "*The Application of Medium Radius Directional Drilling for Coal Bed Methane Extraction*," Lucas Technical Paper, copyrighted 2003, 11 pages.

U.S. Department of Energy, DE–FC26–01NT41148, "*Enhanced Coal Bed Methane Production and Sequestration of CO2 in Unmineable Coal Seams*" for Consol, Inc., accepted Oct. 1, 2001, 48 pages, including cover page.
Notification of Transmittal of the International Search Report or the Declaration (PCT Rule 44.1) mailed Nov. 6, 2003 (8 pages) re International Application No. PCT/US 03/21626, Filed Jul. 11, 2003.
Notification of Transmittal of the International Search Report or the Declaration (PCT Rule 44.1) mailed Nov. 5, 2003 (8 pages) re International Application No. PCT/US 03/21627, Filed Jul. 11, 2003.
Notification of Transmittal of the International Search Report or the Declaration (PCT Rule 44.1) mailed Nov. 4, 2003 (7 pages) re International Application No. PCT/US 03/21628, Filed Jul. 11, 2003.
Notification of Transmittal of the International Search Report or the Declaration (PCT Rule 44.1) mailed Dec. 5, 2003 (8 pages) re International Application No. PCT/US 03/21750, Filed Jul. 11, 2003.
Ian D. Palmer et al., "*Coalbed Methane Well Completions and Stimulations*", Chapter 14, pp. 303–339, Hydrocarbons from Coal, Published by the American Association of Petroleum Geologists, 1993.
B. Gotas et al., "*Performance of Openhole Completed and Cased Horizontal/Undulating Wells in Thin–Bedded, Tight Sand Gas Reservoirs*," Society of Petroleum Engineers, Inc., Oct. 17 through Oct. 19, 2000, pp. 1–7.
R. Sharma, et al., "*Modelling of Undulating Wellbore Trajectories, The Journal of Canadian Petroleum Technology*", XP–002261908, Oct. 18–20, 1993, pp 16–24.
E. F. Balbinski et al., "*Prediction of Offshore Viscous Oil Field Performance*, " European Symposium on Improved Oil Recovery, Aug. 18–20, 1999, pp. 1–10.
McCray and Cole, "*Oil Well Drilling and Technology*," University of Oklahoma Press, pp 315–319, 1959.
Berger and Anderson, "*Modern Petroleum*;" PennWell Books, pp 106–108, 1978.
Howard L. Hartman, et al.; "*SME Mining Engineering Handbook*;" Society for Mining, Metallurgy, and Exploration, Inc.; pp 1946–1950, 2nd Edition, vol. 2, 1992.
Dave Hassan, Mike Chernichen, Earl Jensen, and Morley Frank; "*Multi–lateral technique lowers drilling costs, provides environmental benefits*", Drilling Technology, pp. 41–47, Oct. 1999.
Pend. Pat. App., Joseph A. Zupanick, "*Method and System for Accessing Subterranean Deposits From The Surface*," U.S. Appl. No. 09/444,029, filed Nov. 19, 1999.
Joseph A. Zupanick; Declaration of Experimental Use, pp. 1–3, Nov. 12, 2000.
Pend Pat App, Joseph A. Zupanick "*Method and System for Enhanced Access to a Subterranean Zone*", U.S. Appl. No. 09/769,098, filed Jan. 24, 2001.
Pend Pat App, Joseph A. Zupanick et al., "*Method and System for Accessing Subterranean Zones From a Limited Surface Area*", U.S. Appl. No. 09/773,217, filed Jan. 30, 2001.
Pend Pat App, Joseph A. Zupanick et al., "*Method and System for Accessing a Subterranean Zone From a Limited Surface Area*," U.S. Appl. 09/774,996, filed Jan. 30, 2001.
Pend Pat App, Joseph A. Zupanick, "*Method and System for Accessing Subterranean Deposits From The Surface*," U.S. Appl. No. 09/789,956, filed Feb. 20, 2001.
Pend Pat App, Joseph A. Zupanick, "*Method and System for Accessing Subterranean Deposits From The Surface*," U.S. Appl. No. 09/788,897, filed Feb. 20, 2001.
Pend Pat App, Joseph A. Zupanick, "*Method and System for Accessing Subterranean Deposits From The Surface*," U.S. Appl. No. 09/791,033, filed Feb. 20, 2001.
Gopal Ramaswamy, "*Production History Provides CBM Insights*," Oil & Gas Journal pp. 49, 50 & 52, Apr. 2, 2001.
Pend Pat App, Joseph A. Zupanick, "*Method and System for Accessing Subterranean Deposits From The Surface*," U.S. Appl. No. 09/885,219, filed Jun. 20, 2001.
Weiguo Chi & Luwu Yang, "*Feasibility of Coalbed Methane Exploitation in China*," Horizontal Well Technology, p. 74, Sep. 2001.
Nackerud Product Description.
Gopal Ramaswamy, "*Advances Key For Coalbed Methane*," The American Oil & Gas Reporter, pp. 71 & 73, Oct. 2001.
Pend Pat App, Joseph A. Zupanick et al., "*Method and System for Management of By–Products From Subterranean Zones*," SN, Oct. 19, 2001.
Arfon H. Jones et al., "A Review of the Physical and Mechanical Properties of Coal with Implications for Coal–Bed Methane Well Completion and Production", *Rocky Mountain Association of Geologists*, pp 169–181, 1988.
Joseph C. Stevens, Horizontal Applications for Coal Bed Methane Recovery, 3rd Annual Coalbed and Coal Mine Conference, *Strategic Research Institute*, pp 1–10 slides, Mar. 25, 2002.
R.J. "Bob" Stayton, "Horizontal Wells Boost CBM Recovery", Special Report: Horizontal & Directional Drilling, *The American Oil & Gas Reporter*, pp. 71–75, Aug. 2002.
Kelley et al., U.S. Appl. No. US 2002/0074122 A1 Method and Apparatus for Hydrocarbon Subterranean Recover, Jun. 20, 2002.
Susan Eaton, "Reversal of Fortune", New Technology Magazine, pp. 30–31, Sep. 2002.
James Mahony, "A Shadow of Things to Come", New Technology Magazine, pp. 28–29, Sep. 2002.
Documents Received from Third Party, Great Lakes Directional Drilling, Inc., (12 pages).
U.S. Department of Energy, "Slant Hole Drilling", (1 page), Apr. 1999.
Robert W. Taylor and Richard Russell, Multilateral Technologies Increase Operational Efficiencies in Middle East, Oil & Gas Journal, pp. 76–80, Mar. 16, 1998.
Adam Pasiczynk, "Evolution Simplifies Multilateral Wells", Directional Drilling, pp. 53–55, Jun. 2000.
Steven S. Bell, "Multilateral System with Full Re–Entry Access Installed", World Oil, p. 29, Jun. 1996.
P. Jackson and S. Kershaw, Reducing Long Term Methane Emissions Resulting from Coal Mining, Energy Convers. Mgmt, vol. 37, Nos 6–8, pp. 801–806, 1996.
Pascal Breant, "Des Puits Branches, Chez Total : les puits multi drains", Total Exploration Production, pp. 1–5, Jan. 1999.
Abstract of AU 8549964, Derwent Information Ltd, 1987.

* cited by examiner

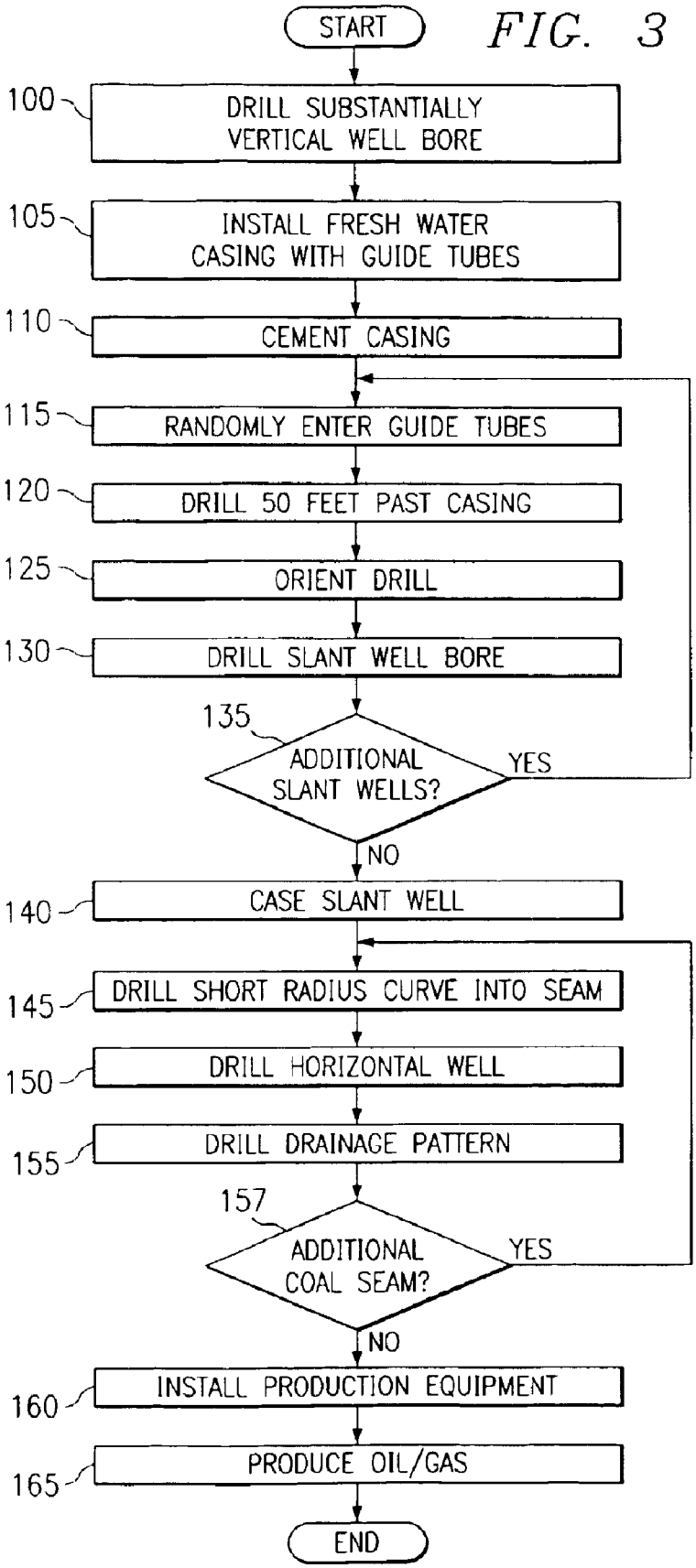
START
FIG. 3
100
DRILL SUBSTANTIALLY VERTICAL WELL BORE
105
INSTALL FRESH WATER CASING WITH GUIDE TUBES
110
CEMENT CASING
115
RANDOMLY ENTER GUIDE TUBES
120
DRILL 50 FEET PAST CASING
125
ORIENT DRILL
130
DRILL SLANT WELL BORE
135
ADDITIONAL SLANT WELLS?
YES
NO
140
CASE SLANT WELL
145
DRILL SHORT RADIUS CURVE INTO SEAM
150
DRILL HORIZONTAL WELL
155
DRILL DRAINAGE PATTERN
157
ADDITIONAL COAL SEAM?
YES
NO
160
INSTALL PRODUCTION EQUIPMENT
165
PRODUCE OIL/GAS
END FIG. 8
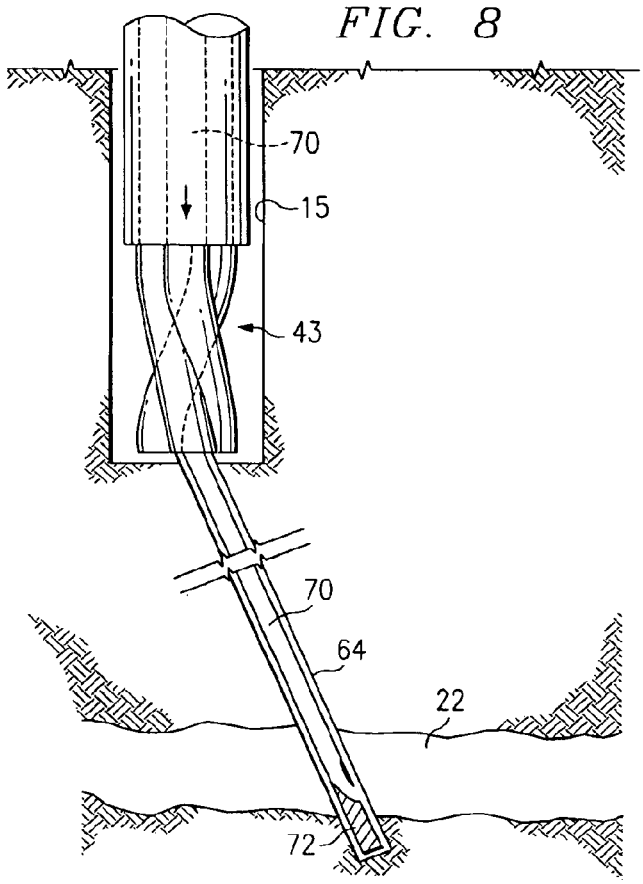
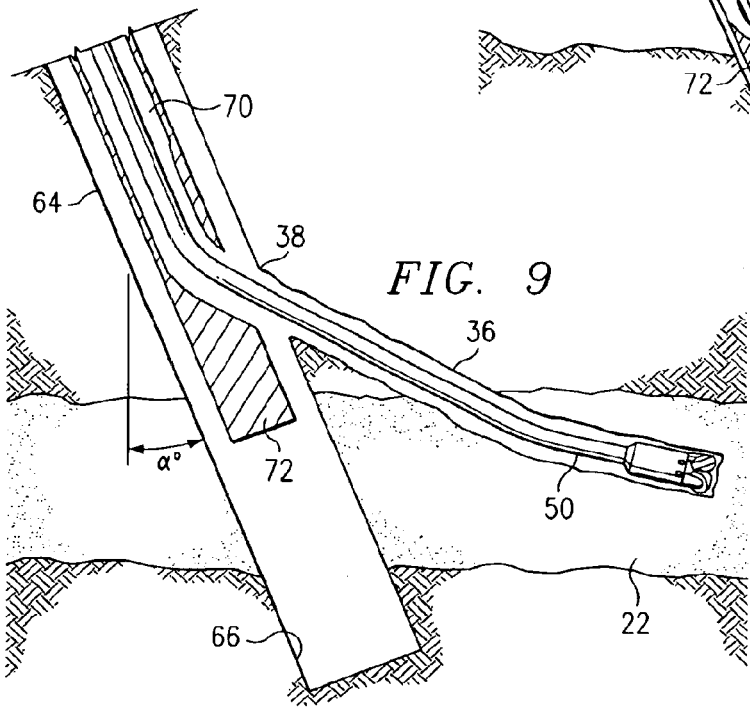
FIG. 9

SLANT ENTRY WELL SYSTEM AND METHOD

TECHNICAL FIELD OF THE INVENTION

The present invention relates generally to systems and methods for the recovery of subterranean resources and, more particularly, to a slant entry well system and method.

BACKGROUND OF THE INVENTION

Subterranean deposits of coal contain substantial quantities of entrained methane gas. Limited production and use of methane gas from coal deposits has occurred for many years. Substantial obstacles, however, have frustrated more extensive development and use of methane gas deposits in coal seams. The foremost problem in producing methane gas from coal seams is that while coal seams may extend over large areas of up to several thousand acres, the coal seams are fairly shallow in depth, varying from a few inches to several meters. Thus, while the coal seams are often relatively near the surface, vertical wells drilled into the coal deposits for obtaining methane gas can only drain a fairly small radius around the coal deposits. Further, coal deposits are not amenable to pressure fracturing and other methods often used for increasing methane gas production from rock formations. As a result, once the gas easily drained from a vertical well bore in a coal seam is produced, further production is limited in volume. Additionally, coal seams are often associated with subterranean water, which must be drained from the coal seam in order to produce the methane.

Horizontal drilling patterns have been tried in order to extend the amount of coal seams exposed to a drill bore for gas extraction. Such horizontal drilling techniques, however, require the use of a radiused well bore which presents difficulties in removing the entrained water from the coal seam. The most efficient method for pumping water from a subterranean well, a sucker rod pump, does not work well in horizontal or radiused bores.

As a result of these difficulties in surface production of methane gas from coal deposits, which must be removed from a coal seam prior to mining, subterranean methods have been employed. While the use of subterranean methods allows water to be easily removed from a coal seam and eliminates under-balanced drilling conditions, they can only access a limited amount of the coal seams exposed by current mining operations. Where longwall mining is practiced, for example, underground drilling rigs are used to drill horizontal holes from a panel currently being mined into an adjacent panel that will later be mined. The limitations of underground rigs limits the reach of such horizontal holes and thus the area that can be effectively drained. In addition, the degasification of a next panel during mining of a current panel limits the time for degasification. As a result, many horizontal bores must be drilled to remove the gas in a limited period of time. Furthermore, in conditions of high gas content or migration of gas through a coal seam, mining may need to be halted or delayed until a next panel can be adequately degasified. These production delays add to the expense associated with degasifying a coal seam.

SUMMARY OF THE INVENTION

The present invention provides a slant entry well system and method for accessing a subterranean zone from the surface that substantially eliminates or reduces the disadvantages and problems associated with previous systems and methods. In particular, certain embodiments of the present invention provide a slant entry well system and method for efficiently producing and removing entrained methane gas and water from a coal seam without requiring excessive use of radiused or articulated well bores or large surface area in which to conduct drilling operations.

In accordance with one embodiment of the present invention, a system for accessing a subterranean zone from the surface includes an entry well bore extending down from the surface. A plurality of slanted well bores extend from the entry well bore to the subterranean zone. Drainage patterns extend from the slanted well bores into the subterranean zone.

According to another embodiment of the present invention, a method for accessing a subterranean zone from the surface includes forming an entry well bore and forming a plurality of slanted well bores from the entry well bore to the subterranean zone. The method also includes forming drainage patterns from the slanted well bores into the subterranean zone.

In accordance with still another embodiment of the present invention, a method for orienting well bores includes forming an entry well bore from the surface and inserting a guide tube bundle into the entry well bore. The guide tube bundle includes a plurality of guide tubes. The guide tubes are configured longitudinally adjacent to one another and include a first aperture at a first end and a second aperture at a second end. The guide tubes may also be twisted around one another. A method also includes forming a plurality of slanted well bores from the entry well bore through the guide tube bundle to a subterranean zone.

Embodiments of the present invention may provide one or more technical advantages. These technical advantages may include the formation of an entry well bore, a plurality of slanted well bores, and drainage patterns to optimize the area of a subsurface formation which may be drained of gas and liquid resources. This allows for more efficient drilling and production and greatly reduces costs and problems associated with other systems and methods. Another technical advantage includes providing a method for orienting well bores using a guide tube bundle inserted into an entry well bore. The guide tube bundle allows for the simple orientation of the slant well bores in relation to one another and optimizes the production of resources from subterranean zones by optimizing the spacing between the slanted well bores.

Other technical advantages of the present invention will be readily apparent to one skilled in the art from the following figures, descriptions, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which:

FIG. 3 illustrates an example method for producing water and gas from a subsurface formation;

FIG. 8 illustrates an example system of an entry well bore and a slanted well bore;

FIG. 9 illustrates an example system of a slanted well bore and an articulated well bore;

DETAILED DESCRIPTION OF THE INVENTION

Figure 1:
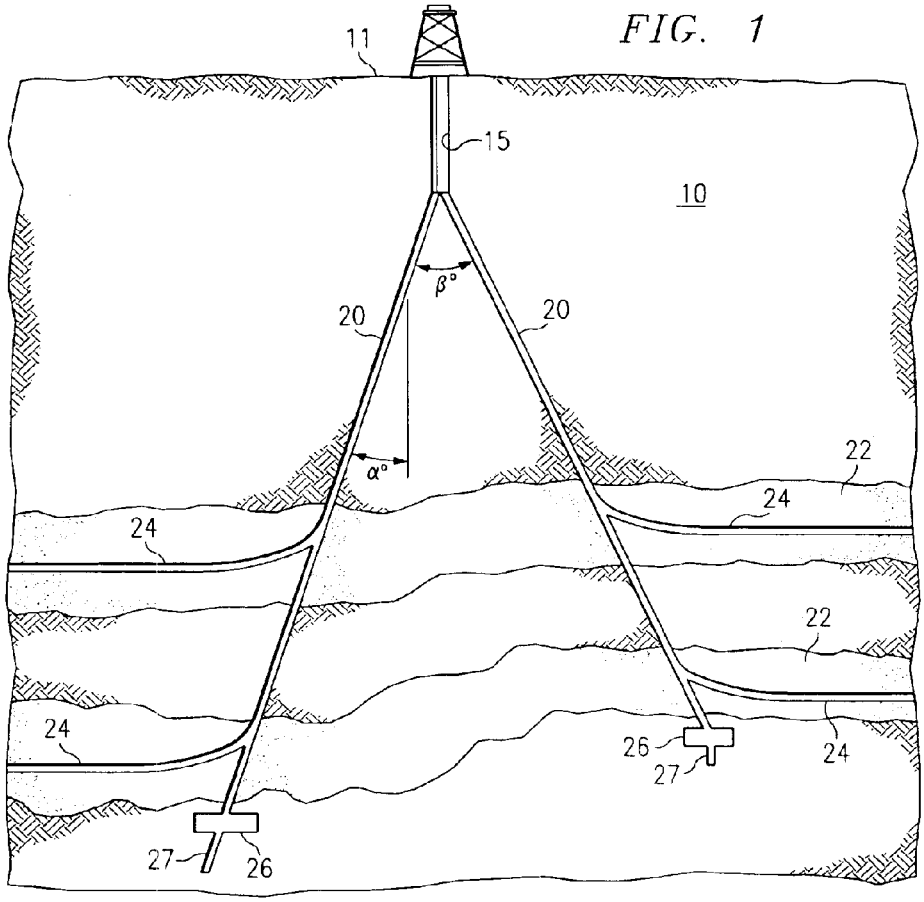
FIG. 1 illustrates an example slant well system for production of resources from a subterranean zone.

FIG. 1 illustrates an example slant well system for accessing a subterranean zone from the surface. In the embodiment described below, the subterranean zone is a coal seam. It will be understood that other subterranean formations and/or low pressure, ultra-low pressure, and low porosity subterranean zones can be similarly accessed using the slant well system of the present invention to remove and/or produce water, hydrocarbons and other fluids in the zone, to treat minerals in the zone prior to mining operations, or to inject or introduce fluids, gases, or other substances into the zone.

Referring to FIG. 1, a slant well system 10 includes an entry well bore 15, slant wells 20, articulated well bores 24, cavities 26, and rat holes 27. Entry well bore 15 extends from the surface 11 towards the subterranean zone 22. Slant wells 20 extend from the terminus of entry well bore 15 to the subterranean zone 22, although slant wells 20 may alternatively extend from any other suitable portion of entry well bore 15. Where there are multiple subterranean zones 22 at varying depths, as in the illustrated example, slant wells 20 extend through the subterranean zones 22 closest to the surface into and through the deepest subterranean zone 22. Articulated well bores 24 may extend from each slant well 20 into each subterranean zone 22. Cavity 26 and rat hole 27 are located at the terminus of each slant well 20.

In FIGS. 1, and, 5–8, entry well bore 15 is illustrated as being substantially vertical; however, it should be understood that entry well bore 15 may be formed at any suitable angle relative to the surface 11 to accommodate, for example, surface 11 geometries and attitudes and/or the geometric configuration or attitude of a subterranean resource. In the illustrated embodiment, slant well 20 is formed to angle away from entry well bore 15 at an angle designated alpha, which in the illustrated embodiment is approximately 20 degrees. It will be understood that slant well 20 may be formed at other angles to accommodate surface topologies and other factors similar to those affecting entry well bore 15. Slant wells 20 are formed in relation to each other at an angular separation of beta degrees, which in the illustrated embodiment is approximately sixty degrees. It will be understood that slant wells 20 may be separated by other angles depending likewise on the topology and geography of the area and location of the target coal seam 22.

Slant well 20 may also include a cavity 26 and/or a rat hole 27 located at the terminus of each slant well 20. Slant wells 20 may include one, both, or neither of cavity 26 and rat hole 27.

Figure 2A:
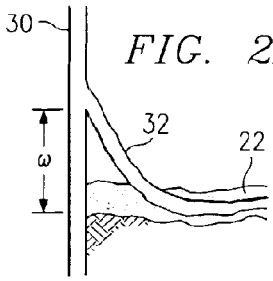
FIG. 2A illustrates a vertical well system for production of resources from a subterranean zone.
Figure 2B:
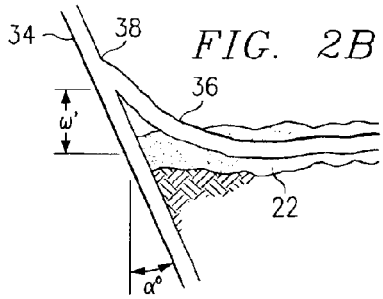
FIG. 2B illustrates a portion of An example slant entry well system in further detail.

FIGS. 2A and 2B illustrate by comparison the advantage of forming slant wells 20 at an angle. Referring to FIG. 2A, a vertical well bore 30 is shown with an articulated well bore 32 extending into a coal seam 22. As shown by the illustration, fluids drained from coal seam 22 into articulated well bore 32 must travel along articulated well bore 32 upwards towards vertical well bore 30, a distance of approximately W feet before they may be collected in vertical well bore 30. This distance of W feet is known as the hydrostatic head and must be overcome before the fluids may be collected from vertical well bore 30. Referring now to FIG. 2B, a slant entry well 34 is shown with an articulated well bore 36 extending into coal seam 22. Slant entry well 34 is shown at an angle alpha away from the vertical. As illustrated, fluids collected from coal seam 22 must travel along articulated well bore 36 up to slant entry well 34, a distance of W' feet. Thus, the hydrostatic head of a slant entry well system is reduced as compared to a substantially vertical system. Furthermore, by forming slant entry well 34 at angle alpha, the articulated well bore 36 drilled from tangent or kick off point 38 has a greater radius of curvature than articulated well bore 32 associated with vertical well bore 30. This allows for articulated well bore 36 to be longer than articulated well bore 32 (since the friction of a drill string against the radius portion is reduced), thereby penetrating further into coal seam 22 and draining more of the subterranean zone.

FIG. 3 illustrates an example method of forming a slant entry well. The steps of FIG. 3 will be further illustrated in subsequent FIGS. 4–11. The method begins at step 100 where the entry well bore is formed. At step 105, a fresh water casing or other suitable casing with an attached guide tube bundle is installed into the entry well bore formed at step 100. At step 110, the fresh water casing is cemented in place inside the entry well bore of step 100.

At step 115, a drill string is inserted through the entry well bore and one of the guide tubes in the guide tube bundle. At step 120, the drill string is used to drill approximately fifty feet past the casing. At step 125, the drill is oriented to the desired angle of the slant well and, at step 130, a slant well bore is drilled down into and through the target subterranean zone.

At decisional step 135, a determination is made whether additional slant wells are required. If additional slant wells are required, the process returns to step 115 and repeats through step 135. Various means may be employed to guide the drill string into a different guide tube on subsequent runs through steps 115–135, which should be apparent to those skilled in the art.

If no additional slant wells are required, the process continues to step 140. At step 140 the slant well casing is installed. Next, at step 145, a short radius curve is drilled into the target coal seam. Next, at step 150, a substantially horizontal well bore is drilled into and along the coal seam. It will be understood that the substantially horizontal well bore may depart from a horizontal orientation to account for changes in the orientation of the coal seam. Next, at step 155, a drainage pattern is drilled into the coal seam through the substantially horizontal well. At decisional step 157, a determination is made whether additional subterranean zones are to be drained as, for example, when multiple subterranean zones are present at varying depths below the surface. If additional subterranean zones are to be drained, the process repeats steps 145 through 155 for each additional subterranean zone. If no further subterranean zones are to be drained, the process continues to step 160.

At step 160, production equipment is installed into the slant well and at step 165 the process ends with the production of water and gas from the subterranean zone.

Although the steps have been described in a certain order, it will be understood that they may be performed in any other appropriate order. Furthermore, one or more steps may be omitted, or additional steps performed, as appropriate.

Figure 4A:
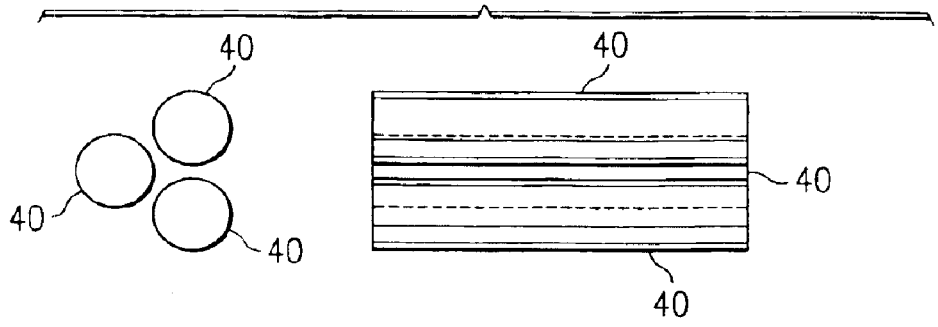
FIGS. 4A–4C illustrate construction of an example guide tube bundle.
Figure 4B:
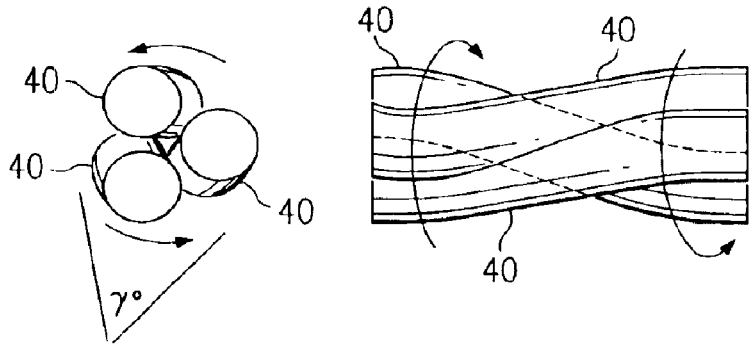
Figure 4C:
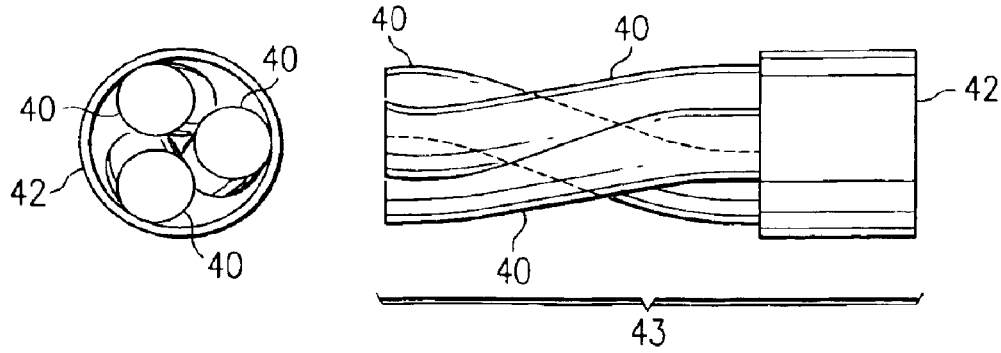

FIGS. 4A, 4B, and 4C illustrate formation of a casing with associated guide tube bundle as described in step 105 of FIG. 3. Referring to FIG. 4A, three guide tubes 40 are shown in side view and end view. The guide tubes 40 are arranged so that they are parallel to one another. In the illustrated embodiment, guide tubes 40 are 9 ⅝" joint casings. It will be understood that other suitable materials may be employed.

FIG. 4B illustrates a twist incorporated into guide tubes 40. The guide tubes 40 are twisted gamma degrees in relation to one another while maintaining the lateral arrangement to gamma degrees. Guide tubes 40 are then welded or otherwise stabilized in place. In an example embodiment, gamma is equal to 10 degrees.

FIG. 4C illustrates guide tubes 40, incorporating the twist, in communication and attached to a casing collar 42. The guide tubes 40 and casing collar 42 together make up the guide tube bundle 43, which may be attached to a fresh water or other casing sized to fit the length of entry well bore 15 of FIG. 1 or otherwise suitably configured.

Figure 5:
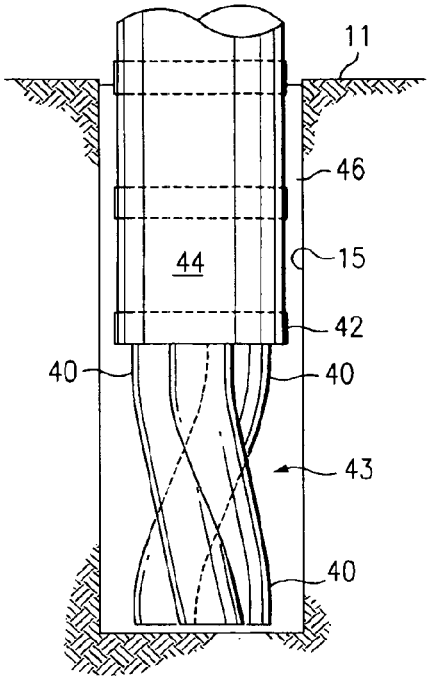
FIG. 5 illustrates an example entry well bore with an installed guide tube bundle.

FIG. 5 illustrates entry well bore 15 with guide tube bundle 43 and casing 44 installed in entry well bore 15. Entry well bore 15 is formed from the surface 11 to a target depth of approximately three hundred and ninety feet. Entry well bore 15, as illustrated, has a diameter of approximately twenty-four inches. Forming entry well bore 15 corresponds with step 100 of FIG. 3. Guide tube bundle 43 (consisting of joint casings 40 and casing collar 42) is shown attached to a casing 44. Casing 44 may be any fresh water casing or other casing suitable for use in down-hole operations. Inserting casing 44 and guide tube bundle 43 into entry well bore 15 corresponds with step 105 of FIG. 3.

Corresponding with step 110 of FIG. 3, a cement retainer 46 is poured or otherwise installed around the casing inside entry well bore 15. The cement casing may be any mixture or substance otherwise suitable to maintain casing 44 in the desired position with respect to entry well bore 15.

Figure 6:
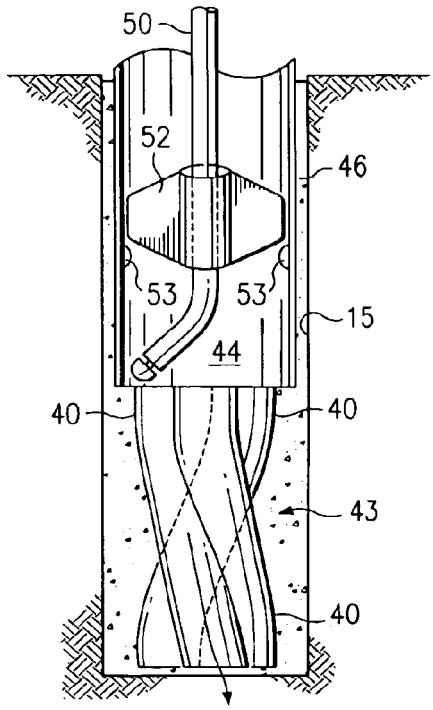
FIG. 6 illustrates the use of an example guide tube bundle in an entry well bore.

FIG. 6 illustrates entry well bore 15 and casing 44 with guide tube 43 in its operative mode as slant wells 20 are about to be drilled. A drill string 50 is positioned to enter one of the guide tubes 40 of guide tube bundle 43. In order to keep drill string 50 relatively centered in casing 44, a stabilizer 52 may be employed. Stabilizer 52 may be a ring and fin type stabilizer or any other stabilizer suitable to keep drill string 50 relatively centered. To keep stabilizer 52 at a desired depth in well bore 15, stop ring 53 may be employed. Stop ring 53 may be constructed of rubber or metal or any other foreign down-hole environment material suitable. Drill string 50 may be inserted randomly into any of a plurality of guide tubes 40 of guide tube bundle 43, or drill string 50 may be directed into a selected joint casing 40. This corresponds to step 115 of FIG. 3.

Figure 7:
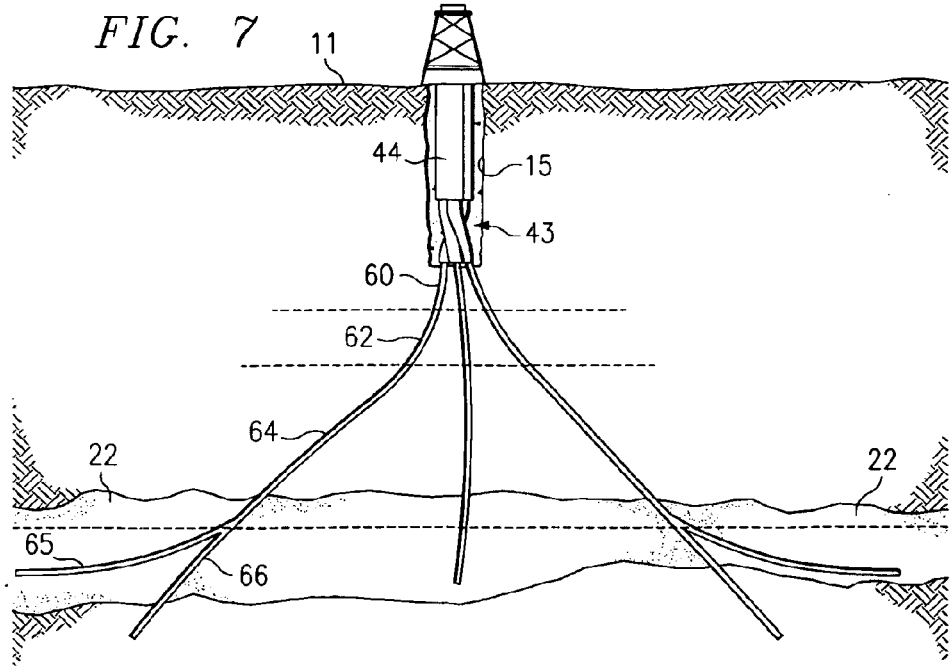
FIG. 7 illustrates an example system of slanted well bores.

FIG. 7 illustrates an example system of slant wells 20. Corresponding with step 120 of FIG. 3, tangent well bore 60 is drilled approximately fifty feet past the end of entry well bore 15 (although any other appropriate distance may be drilled). Tangent well bore 60 is drilled away from casing 44 in order to minimize magnetic interference and improve the ability of the drilling crew to guide the drill bit in the desired direction. Corresponding with step 125 of FIG. 3, a radiused well bore 62 is drilled to orient the drill bit in preparation for drilling the slant entry well bore 64. In a particular embodiment, radiused well bore 62 is curved approximately twelve degrees per one hundred feet (although any other appropriate curvature may be employed).

Corresponding with step 130 of FIG. 3, a slant entry well bore 64 is drilled from the end of the radius well bore 62 into and through the subterranean zone 22.

Alternatively, slant well 20 may be drilled directly from guide tube 40, without including tangent well bore 60 or radiused well bore 62. An articulated well bore 65 is shown in its prospective position but is drilled later in time than rat hole 66, which is an extension of slant well 64. Rat hole 66 may also be an enlarged diameter cavity or other suitable structure. After slant entry well bore 64 and rat hole 66 are drilled, any additional desired slant wells are then drilled before proceeding to installing casing in the slant well.

FIG. 8 is an illustration of the casing of a slant well 64. For ease of illustration, only one slant well 64 is shown. Corresponding with step 140 of FIG. 3, a whip stock casing 70 is installed into the slant entry well bore 64. In the illustrated embodiment, whip stock casing 70 includes a whip stock 72 which is used to, mechanically direct a drill string into a desired orientation. It will be understood that other suitable casings may be employed and the use of a whip stock 72 is not necessary when other suitable methods of orienting a drill bit through slant well 64 into the subterranean zone 22 are used.

Casing 70 is inserted into the entry well bore 15 through guide tube bundle 43 and into slant entry well bore 64. Whip stock casing 70 is oriented such that whip stock 72 is positioned so that a subsequent drill bit is aligned to drill into the subterranean zone 22 at the desired depth.

FIG. 9 illustrates whip stock casing 70 and slant entry well bore 64. As discussed in conjunction with FIG. 8, whip stock casing 70 is positioned within slant entry well bore 64 such that a drill string 50 will be oriented to pass through slant entry well bore 64 at a desired tangent or kick off point 38. This corresponds with step 145 of FIG. 3. Drill string 50 is used to drill through slant entry well bore 64 at tangent or kick off point 38 to form articulated well bore 36. In a particular embodiment, articulated well bore 36 has a radius of approximately seventy-one feet and a curvature of approximately eighty degrees per one hundred feet. In the same embodiment, slant entry well 64 is angled away from the vertical at approximately ten degrees. In this embodiment, the hydrostatic head generated in conjunction with production is roughly thirty feet. However, it should be understood that any other appropriate radius, curvature, and slant angle may be used.

Figure 10:
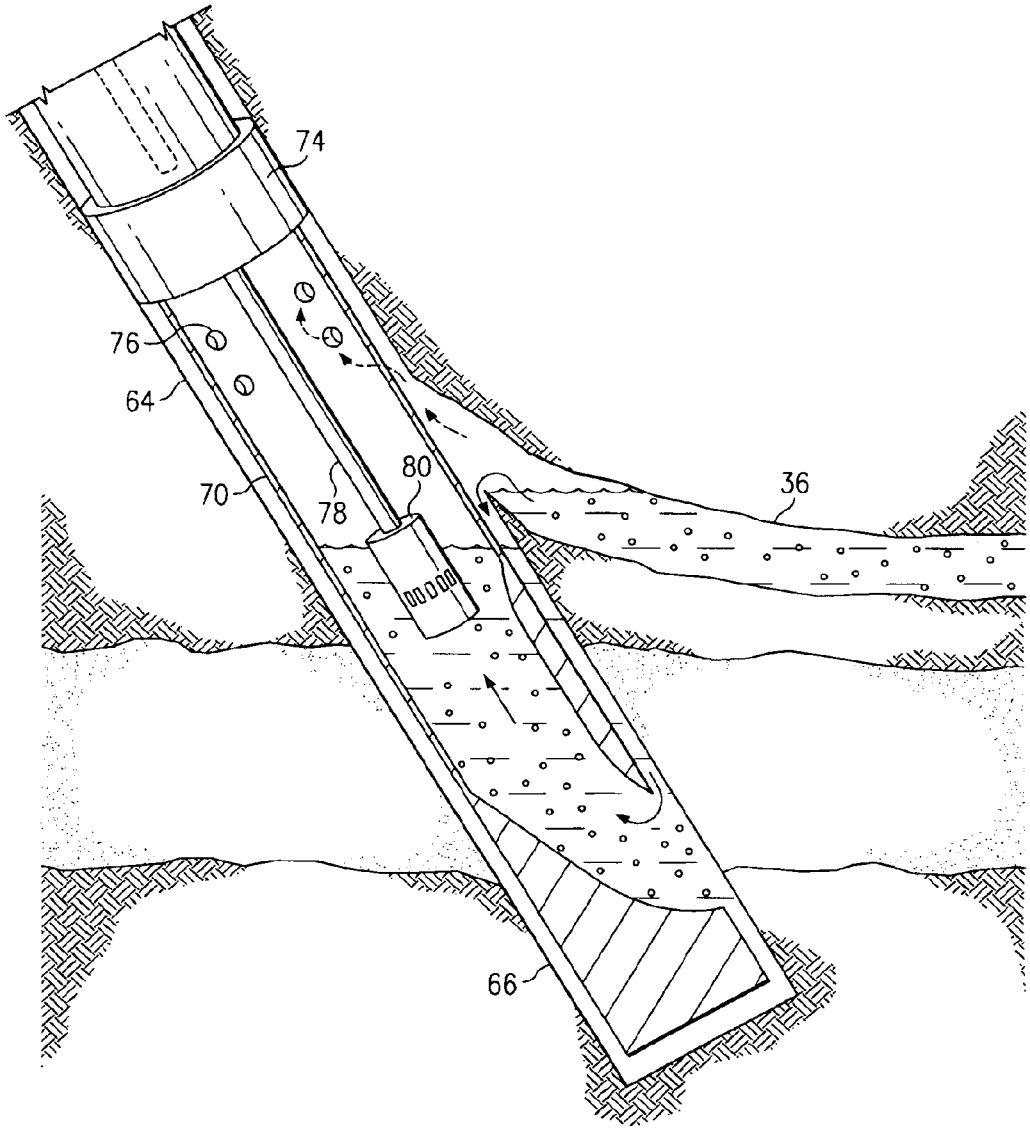
FIG. 10 illustrates production of water and gas in an example slant well system.

FIG. 10 illustrates a slant entry well 64 and articulated well bore 36 after drill string 50 has been to form articulated well bore 36. In a particular embodiment, a horizontal well and drainage pattern may then be formed in subterranean zone 22, as represented by step 150 and step 155 of FIG. 3.

Referring to FIG. 10, whip stock casing 70 is set on the bottom of rat hole 66 to prepare for production of oil and gas. A sealer ring 74 may be used around the whip stock casing 70 to prevent gas produced from articulated well bore 36 from escaping outside whip stock casing 70. Gas ports 76 allow escaping gas to enter into and up through whip stock casing 70 for collection at the surface.

A pump string 78 and submersible pump 80 is used to remove water and other liquids that are collected from the subterranean zone through articulated well bore 36. As shown in FIG. 10, the liquids, under the power of gravity and the pressure in subterranean zone 22, pass through articulated well bore 36 and down slant entry well bore 64 into rat hole 66. From there the liquids travel into the opening in the whip stock 72 of whip stock casing 70 where they come in contact with the installed pump string 78 and submersible pump 80. Submersible pump 80 may be a variety of submersible pumps suitable for use in a down-hole environment to remove liquids and pump them to the surface through pump string 78. Installation of pump string 78 and submersible pump 80 corresponds with step 160 of FIG. 3. Production of liquid and gas corresponds with step 165 of FIG. 3.

Figure 11:
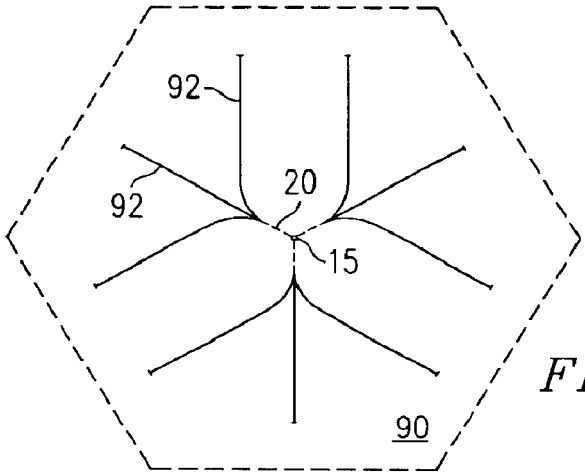
FIG. 11 illustrates an example drainage pattern for use with a slant well system.

FIG. 11 illustrates an example drainage pattern 90 that may be drilled from articulated well bores 36. At the center of drainage pattern 90 is entry well bore 15. Connecting to entry well bore 15 are slant wells 20. At the terminus of slant well 20, as described above, are substantially horizontal well bores 92 roughly forming a "crow's foot" pattern off of each of the slant wells 20. As used throughout this application, "each" means all of a particular subset. In a particular embodiment, the horizontal reach of each substantially horizontal well bore 92 is approximately fifteen hundred feet. Additionally, the lateral spacing between the parallel substantially horizontal well bores 92 is approximately eight hundred feet. In this particular embodiment, a drainage area of approximately two hundred and ninety acres would result. In an alternative embodiment where the horizontal reach of the substantially horizontal well bore 92 is approximately two thousand four hundred and forty feet, the drainage area would expand to approximately six hundred and forty acres. However, any other suitable configurations may be used. Furthermore, any other suitable drainage patterns may be used.

Figure 12:
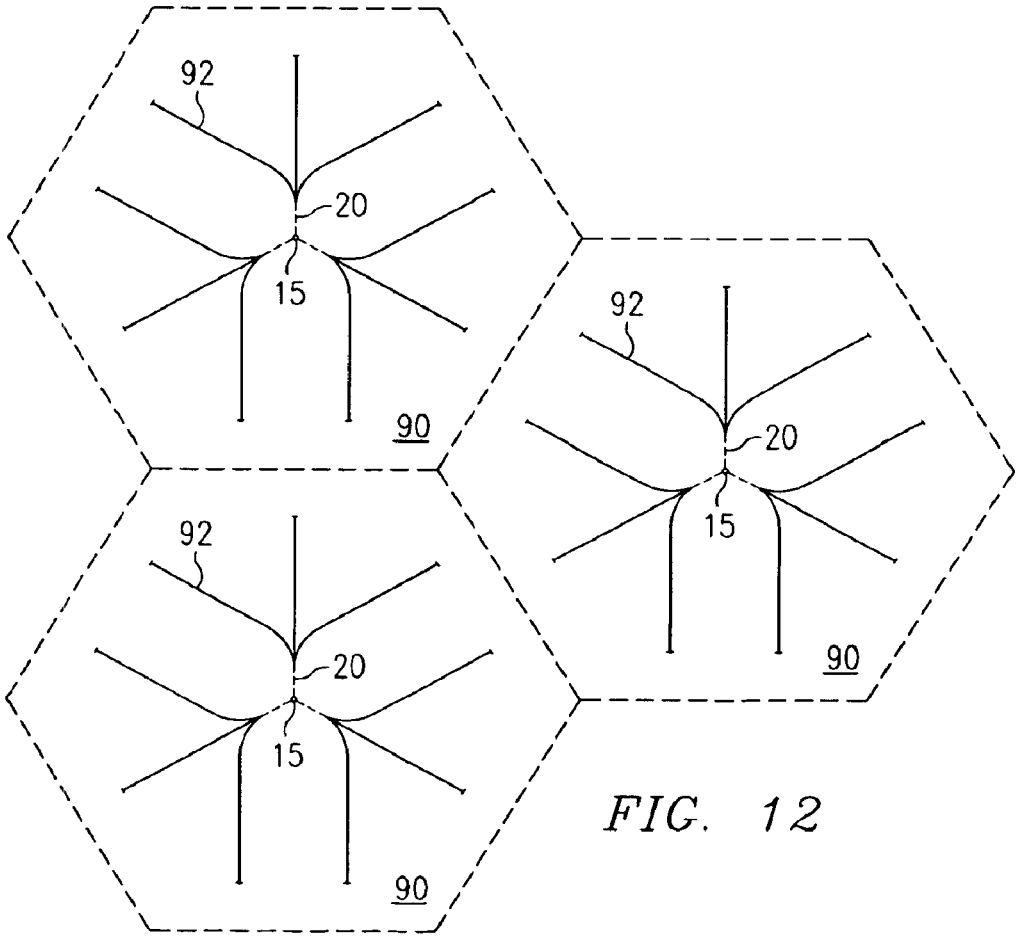
FIG. 12 illustrates an example alignment of drainage patterns for use with a slant well system.

FIG. 12 illustrates a plurality of drainage patterns 90 in relationship to one another to maximize the drainage area of a subsurface formation covered by the drainage patterns 90. Each drainage pattern 90 forms a roughly hexagonal drainage pattern. Accordingly, drainage patterns 90 may be aligned, as illustrated, so that the drainage patterns 90 form a roughly honeycomb-type alignment.

Although the present invention has been described with several embodiments, various changes and modifications may be suggested to one skilled in the art. It is intended that the present invention encompass such changes and modifications as fall within the scope of the appended claims.

What is claimed is:

1. A method for accessing a subterranean zone from the surface, comprising:

forming an entry well bore from the surface;

forming two or more slanted well bores from the entry well bore to the subterranean zone;

forming a substantially horizontal drainage pattern from at least one of the slanted well bores into the subterranean zone; and forming a rat hole associated with at least one of the slant well bores and extending below the substantially horizontal drainage pattern, the rat hole formed such that water and other fluids from the subterranean zone drain through the substantially horizontal drainage pattern and collect in the rat hole to facilitate removal of the fluids from the subterranean zone.

2. The method of claim 1, wherein the two or more slanted well bores are radially spaced approximately equally around the vertical well bore.

3. The method of claim 1, wherein three slanted well bores are formed.

4. The method of claim 3, wherein the three slanted well bores are radially spaced around the vertical well bore approximately 120 degrees apart.

5. The method of claim 1, wherein the horizontal drainage pattern comprises one or more lateral well bores.

6. The method of claim 5, wherein the lateral well bores are configured to drain an area of the subterranean zone of at least 640 acres.

7. The method of claim 1, further comprising removing resources from the subterranean zone through the horizontal drainage patterns to the surface.

8. The method of claim 1, further comprising forming an enlarged cavity in each of the slanted well bores proximate to the subterranean zone.

9. The method of claim 1, further comprising positioning a submersible pump in the rat hole, the submersible pump operable to remove the water and other fluids collected in the rat hole from the subterranean zone.

10. A system for accessing a subterranean zone from the surface, comprising:

an entry well bore extending from the surface;

two or more slanted well bores extending from the entry well bore to the subterranean zone;

a substantially horizontal drainage pattern extending from at least one of the slanted well bores into the subterranean zone; and a rat hole associated with at least one of the slant well bores and extending below the substantially horizontal drainage pattern, the rat hole formed such that water and other fluids from the subterranean zone drain through the substantially horizontal drainage pattern and collect in the rat hole to facilitate removal of the fluids from the subterranean zone.

11. The system of claim 10, wherein the two or more slanted well bores are radially spaced approximately equally around the vertical well bore.

12. The system of claim 10, further comprising three slanted well bores.

13. The system of claim 12, wherein the three slanted well bores are radially spaced around the vertical well bore approximately 120 degrees apart.

14. The system of claim 10, wherein the horizontal drainage pattern comprises one or more lateral well bores.

15. The system of claim 14, wherein the lateral well bores are configured to drain an area of the subterranean zone of at least 640 acres.

16. The system of claim 10, further comprising forming an enlarged cavity in each of the slanted well bores proximate to the subterranean zone.

17. The system of claim 10, further comprising a submersible pump positioned in the rat hole, the submersible pump operable to remove the water and other fluids collected in the rat hole from the subterranean zone.

18. A method for accessing a subterranean zone from the surface, comprising:

forming two or more slanted well bores extending to the subterranean zone, the two or more slanted well bores formed from a common surface area;

forming in the subterranean zone one or more substantially horizontal drainage patterns each intersecting at least one of the slanted well bores; and forming a rat hole associated with each slant well bore and extending below the substantially horizontal drainage pattern, the rat hole formed such that water and other fluids from the subterranean zone drain through the substantially horizontal drainage pattern and collect in the rat hole to facilitate removal of the fluids from the subterranean zone.

19. The method of claim 18, further comprising:

collecting the fluid in the rat hole associated with each of the two or more slanted well bores; and pumping the fluid to the surface using a submersible pump positioned in the rat hole.

20. A method for accessing a subterranean zone from the surface, comprising:

forming an entry well bore from the surface;

forming two or more slanted well bores from the entry well bore to the subterranean zone;

forming in the subterranean zone one or more substantially horizontal drainage patterns each intersecting at least one of the slanted well bores; and forming a rat hole associated with each slant well bore and extending below the substantially horizontal drainage pattern, the rat hole formed such that water and other fluids from the subterranean zone drain through the substantially horizontal drainage pattern and collect in the rat hole to facilitate removal of the fluids from the subterranean zone.

21. The method of claim 20, further comprising:

collecting the fluid in the rat hole associated with each of the two or more slanted well bores; and pumping the fluid to the surface using a submersible pump positioned in the rat hole.

* * * * *